US005101525A

United States Patent [19]

Ippolito

[11] Patent Number: 5,101,525

[45] Date of Patent: Apr. 7, 1992

[54] COMBINATION STAKE ANCHORED DOWN BEACH AND LAWN BLANKET

[76] Inventor: Nicholas W. Ippolito, 35 Gehrig St., Commack, N.Y. 11725

[21] Appl. No.: 731,461

[22] Filed: Jul. 17, 1991

[51] Int. Cl.[5] ..... A47G 9/06; E04H 15/62

[52] U.S. Cl. ..... 5/417; 135/118

[58] Field of Search ..... 5/417–420, 5/508; 135/118; 248/508; 24/72.5

[56] References Cited

U.S. PATENT DOCUMENTS

| | | | |
|---|---|---|---|
| 2,358,089 | 9/1944 | Le Gere | 135/118 |
| 2,840,092 | 6/1958 | Hill | 248/508 |
| 3,237,904 | 3/1966 | Abruzese | 135/118 |
| 3,456,660 | 7/1969 | Borchardt | 135/118 |

FOREIGN PATENT DOCUMENTS

| | | | |
|---|---|---|---|
| 2470183 | 6/1981 | France | 24/72.5 |

*Primary Examiner*—Alexander Grosz
*Attorney, Agent, or Firm*—Leonard Belkin

[57] ABSTRACT

A stake assembly that when used in conjunction with a properly equipped blanket fitted with eyelets will anchor the blanket to either a beach surface or a lawn surface.

The stake assembly includes a short member for use on a lawn and a sleeve member which is added to the short member for use on a beach.

4 Claims, 1 Drawing Sheet

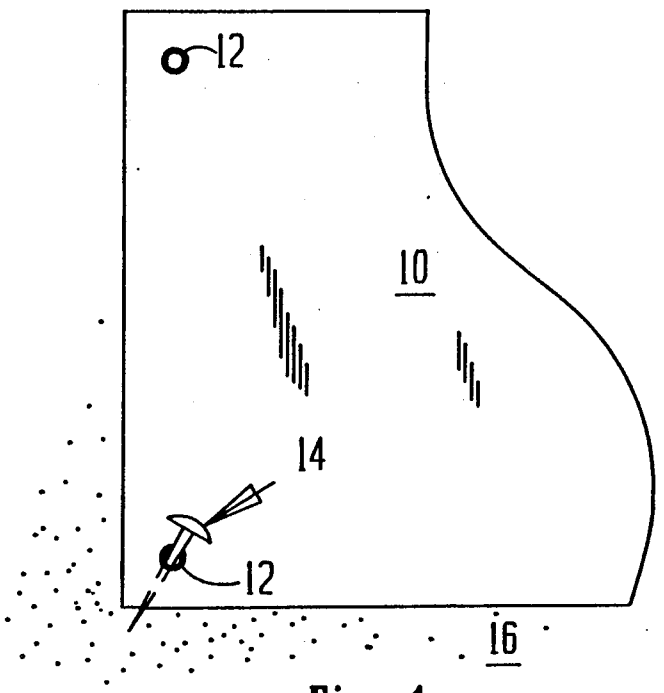
Fig. 1
Fig. 2
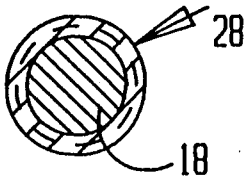
Fig. 3
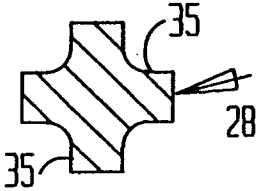
Fig. 4
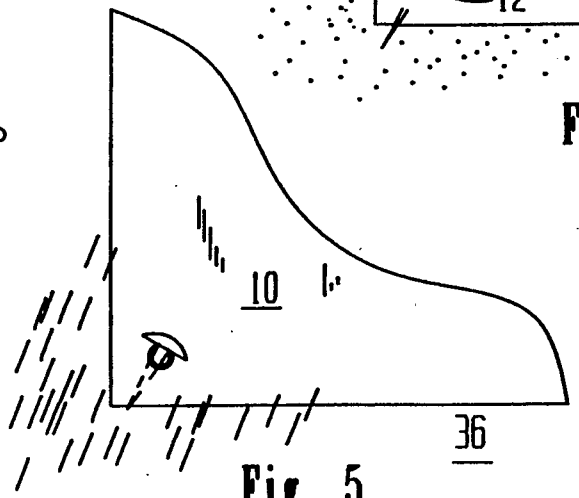
Fig. 5
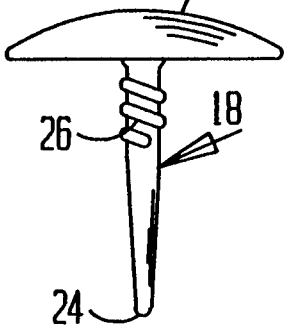
Fig. 6

COMBINATION STAKE ANCHORED DOWN BEACH AND LAWN BLANKET

BACKGROUND OF THE INVENTION

The instant invention relates generally to blankets and more specifically it relates to an anchored down blanket which, because of the combination stake described herein, is suitable for use on either a beach or a lawn surface.

Some methods have been provided in prior art that are adapted to include structures thereon so that a blanket can be secured to the ground. For example, U.S. Pat. No. 2,809,006 to Jansey; U.S. Pat. No. 2,840,092 to Hill and U.S. Pat. No. 3,237,904 to Ambruzese all are illustrative of such prior art. While these units may be suitable for the particular purpose to which they address, they would not be as suitable for the purposes of the present invention as heretofore described.

SUMMARY OF THE INVENTION

A primary objective of the present invention is to provide an anchored down beach and lawn blanket that will overcome the shortcomings of the prior art devices.

Another objective is to provide an anchored down beach and lawn blanket in which each corner includes a structure thereon for removably securing each corner to the ground so as to make the blanket firm, taut and wind resistant.

An additional objective is to provide an anchored down beach and lawn blanket in which the structure for securing each corner to the ground is a stake extending from each corner, and is removable.

A still further objective is to provide for a combination stake to be used on either a lawn or the beach to anchor down the blanket that is simple and easy to use.

A still further objective is to provide an anchored down beach and lawn blanket that is economical in cost to manufacture.

Further objectives of the invention will appear as the description proceeds.

To the accomplishment of the above and related objectives, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a plan view of a preferred embodiment of the invention being used on a sand surface.

FIG. 2 is an elevation view in partial section of a stake assembly employed in FIG. 1.

FIG. 3 is a section taken along 3—3 of FIG. 2.

FIG. 4 is section taken along 4—4 of FIG. 2.

FIG. 5 is a plan view of the blanket shown in FIG. 1 being used on a lawn.

FIG. 6 is an elevation view of the stake being employed in FIG. 5.

DETAILED DESCRIPTION OF THE PREFERRED EMBODIMENTS

Turning now descriptively to the drawings, in which similar reference characters denote similar elements throughout the several views, FIG. 1 illustrates a sheet

10 having an eyelet 12 in each corner for receiving a stake assembly 14 which is anchored in sand 16 to hold sheet 10 in place. Sheet 10 is made of flexible material, such as cloth, canvas and the like.

Each stake assembly 14, best seen in FIGS. 2–4, comprises a shank member 18 having an enlarged head 22 at one end and a point 24 at other end. Shank member 18 is provided with a helical rib 26 for a purpose to be described.

Shank member 18 is threaded into a pointed sleeve member 28 tapering to a point 32 at one end and an opening at the other end to receive shank member 18. The interior of sleeve member 28 is provided with a helical groove 34 to threadably receive helical rib 26 as shown in FIG. 2. Sleeve member 28 is also provided with flutes 35 on the outside extending the length of the tapered section to facilitate its use in sand as noted below. The interior of sleeve member 28 may be provided with any other snap-in and out mechanism for engaging shank member 18.

With stake assembly 14 elongated using sleeve member 28, it is possible to embed stake 14 deeply into sand 16 which is required to secure blanket 10 in place.

However, when blanket 10 is employed on a lawn 36 as seen in FIG. 5, it is neither possible, nor necessary to have stake assembly 14 embedded so deeply into lawn 36.

To use the anchored down blanket 10 on sand, a person simply places the stake assemblies 14 through eyelets 12 in each corner of sheet 10 and presses them into the sand 16 as shown in FIG. 1. To use the blanket 10 on a lawn, as seen in FIG. 5, shank members 18 are removed from sleeve members 28 and inserted through eyelets 12 into the lawn surface 36. Shank members 18 are shorter than assemblies 14 so that they can be embedded into lawn 36 until head 22 is flush with blanket 10 whereas it may not be possible to embed assembly 14 completely through the dirt in lawn 36. In view of the consistency of the material in lawn 36, a short penetration should be adequate to secure blanket 10 in place.

Due to the consistency of sand 16, a much deeper penetration is required to secure blanket 10, and sleeve member 28 fulfills that purpose.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An anchored down blanket for use on both a beach and a lawn comprising:

a. a sheet of flexible material;

b. eyelet means at each corner of said sheet;

c. stake means passing through each of said eyelet means embedded into the ground for securing said blanket to said ground;

d. said stake means comprising a shank member having an enlarged head with a body extending therefrom and pointed at the other end, said shank member being removably inserted and fastened into an elongated sleeve member, said sleeve member being hollow and open at one end to receive the body of said shank member and tapered to a point at the other end, for use when said ground is sand, said sleeve member being removed to permit said shank member to be used alone when said ground is a lawn surface.

2. The anchored down beach and lawn blanket of claim 1 in which said shank member and sleeve member include means for having positive engagement when assembled.

3. The anchored down beach and lawn blanket of claim 1 in which the body of said shank member is provided with a helical rib, said sleeve member being provided with a helical groove for permitting said shank member to be positively engaged with said sleeve member.

4. The anchored down beach and lawn blanket of claim 3 in which the tapered section of said sleeve member is provided with flutes to facilitate anchoring in sand.

* * * * *